United States Patent [19]

Yazaki et al.

[11] Patent Number: 4,549,453

[45] Date of Patent: Oct. 29, 1985

[54] APPARATUS FOR CUTTING OUT AN EDGE PORTION OF A COATING SHEET

[75] Inventors: Susumu Yazaki, Kodaira; Jun Nagano, Higashimurayama, both of Japan

[73] Assignee: Bridgestone Tire Company Limited, Tokyo, Japan

[21] Appl. No.: 564,102

[22] Filed: Dec. 21, 1983

[30] Foreign Application Priority Data

Dec. 29, 1982 [JP] Japan ..... 57-230060

[51] Int. Cl.[4] ..... B26D 5/00

[52] U.S. Cl. ..... 83/365; 83/368; 83/371; 250/548

[58] Field of Search ..... 83/359, 365, 367, 368, 83/371; 250/548, 557

[56] References Cited

U.S. PATENT DOCUMENTS

| | | | |
|---|---|---|---|
| 2,031,503 | 2/1936 | Rainey | 83/365 |
| 3,719,114 | 3/1973 | Vischulis | 83/368 |
| 4,173,912 | 11/1979 | Holp | 83/368 |

*Primary Examiner*—Frank T. Yost
*Assistant Examiner*—Hien H. Phan
*Attorney, Agent, or Firm*—Sughrue, Mion, Zinn, Macpeak and Seas

[57] ABSTRACT

An apparatus for cutting out an edge portion of a coating sheet wherein a plurality of cords arranged at substantially equal intervals and in parallel with each other and conveyed along a predetermined path are integrally coated with rubber or the like in such a manner that the cord portions are expanded, to a predetermined length from the most externally positioned cord portion of the coating sheet in transversal direction thereof is disclosed.

7 Claims, 8 Drawing Figures

APPARATUS FOR CUTTING OUT AN EDGE PORTION OF A COATING SHEET

BACKGROUND OF THE INVENTION

The present invention relates to an apparatus for cutting an edge portion or a selvage rubber portion of a coating sheet wherein a plurality of cords arranged at substantially equal intervals and in parallel with each other and conveyed along a predetermined path are integrally coated with rubber or the like in such a manner that the cord portions are expanded, to a predetermined length from the most externally positioned cord portion of the coating sheet in transversal direction thereof.

The coating sheet wherein the cord portions are expanded includes, for example, rubber coating sheets embedding reinforcing cords therein, which are used for production of a tire and the like. The coating sheet is produced by coating a tire cord fabric in which a plurality of cords 1-1, 1-2, . . ., **1-*n* are arranged at substantially equal intervals and in parallel with each other as shown in FIG. 1 with rubber 3 by feeding the tire cord fabric into a calender having rolls 2-1, 2-2, 2-3 and 2-4 as shown in FIG. 2 in the longitudinal direction shown by an arrow A. FIG. 3 shows a cross-sectional view of the thus produced coating sheet 4 and the coated portions (cord portions) 5-1, 5-2, . . ., 5-*n* where the cords 1-1, 1-2, . . ., 1-*n* are coated with rubber, are expanded, that is, the thickness (diameter) of the coated portions (cord portions) is larger than that of flat portions 6 which connect the cords with each other, and the coating sheet has selvage rubber portions 7 which extend outwardly from the most externally positioned cord portions 5-1 and 5-*n* respectively in uneven width. The coating sheet 4 is cut at a given angle and in a given width and the thus cut coating sheets are press-bonded and connected at the selvage rubber portions 7 in such a manner that the cords are placed at a given angle to the longitudinal direction, thereby forming a long cord inclined or bias fabric. In the thus formed cord inclined fabric, it is the necessary conditions for producing the tires which are high in the drive feeling and are strong and safe, that the distance between the cords is constant. To this end, it is necessary to precisely cut out the width of the selvage rubber portions 7** to be press-bonded and connected, to the given width.

In one conventional means, use is made of a cord position detecting device including a magnetic sensor as described in, for example, Japanese Utility Model Laid-open No. 26,234/81, the position of the most externally positioned cord is detected, and a cutter is placed at a predetermined position to the detected cord position, thereby cutting out the selvage rubber portions to the given width. In another conventional technique, use is made of an apparatus for measuring width of the selvage rubber portion including a light receiving element array as described in Japanese Patent Laid-open No. 125,805/82, the width of selvage rubber portion is optically measured and a cutter is placed at a predetermined position to the most externally positioned cord portion based on the detected salvage rubber portion, thereby cutting out the selvage rubber portion to the given width. In the former cutting device, however, the position of the cord is detected by the magnetic sensor so that the cutting device can be applied to only the cord consisting of steel and cannot be applied to the cord consisting of organic fibers, such as nylon and thus this cutting device cannot be utilized for various purposes. In the latter cutting device, on the contrary, width of the selvage rubber portion is optically measured so that the cutting device can be effectively applied to whether the cord consists of steel or of textile. This device, however, comprises a light source for illuminating the coating sheet and a light receiving element array for receiving reflected light from the coating sheet which are directly arranged near the coating sheet, in order to measure width of the selvage rubber portion so that the measuring device becomes large. The measuring device and the cutter, therefore, cannot be arranged integrally so that the distance between them becomes great in the conveying direction of the coating sheet. This causes a time lag so that the selvage rubber portion cannot be cut out to a given width. It is desirable to develop an apparatus capable of cutting the selvage rubber portion of the coating sheet to the given width with high precision, regardless of kind of cords such as steel cord or textile cord.

SUMMARY OF THE INVENTION

It is an object of the present invention to eliminate the above described defects of the conventional apparatus and to satisfy the above mentioned requirement.

It is another object of the present invention to provide an apparatus for cutting an edge portion or selvage rubber portion of the coating sheet which is capable of cutting out an edge portion of the coating sheet to the given length with high precision even though the coating sheet utilizes different types of cords.

According to the present invention there is provided an apparatus for cutting out an edge portion of a coating sheet wherein a plurality of cords arranged at substantially equal intervals and in parallel with each other and conveyed along a predetermined path are integrally coated with rubber or the like in such a manner that the cord portions are expanded, to a predetermined length from the most externally positioned cord portion of the coating sheet in transversal direction thereof comprising a cutter for cutting out the an edge portion of the conveying coating sheet, a projection means having a light source and a light guide which projects light emanated from the light source onto a region including at least the most externally positioned cord portion of the coating sheet, a detection means having an image guide which receives light projected by the projection means and reflected from the coating sheet and for detecting the position of the most externally positioned cord portion based on the intensity distribution of the light emanated from the image guide, a head for integrally holding the cutter, the exit end portion of the light guide and the entrance end portion of the image guide, a head translating means for moving the head in the transversal direction of the coating sheet, and means for controlling the head translating means based on the output of the detection means in such a manner that the cutter is always positioned at the predetermined position to the most externally positioned cord portion of the coating sheet.

DESCRIPTION OF THE PREFERRED EMBODIMENTS

Figure 1:
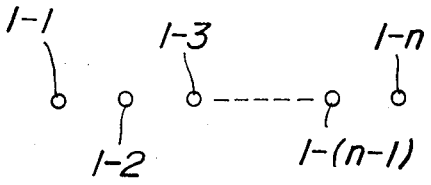
FIG. 1 is a cross-sectional view showing the arrangement of a plurality of cords for forming a coating sheet.
Figure 2:
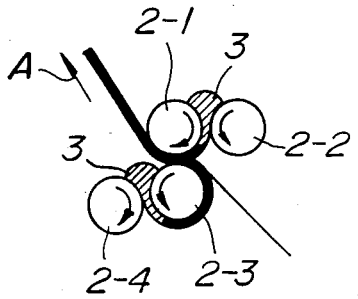
FIG. 2 is a schematic view showing the step for forming a coating sheet by coating the plurality of cords shown in FIG. 1 with rubber through a calender.
Figure 3:
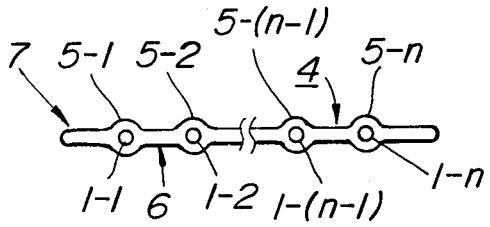
FIG. 3 is a cross-sectional view showing the coating sheet in the transversal direction thereof.
Figure 4A:
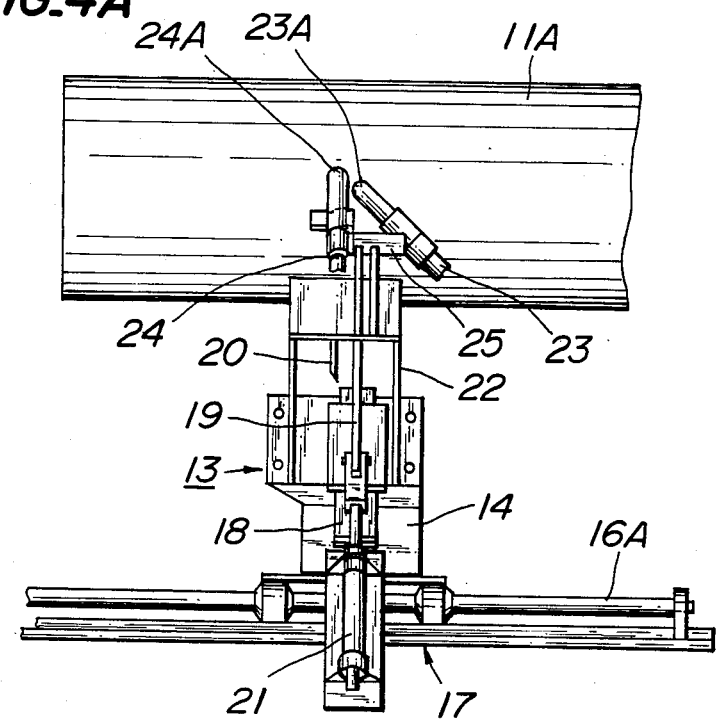
FIG. 4A is a plan view showing the construction of one embodiment of a head portion for use in an apparatus for cutting end portion of a coating sheet according to the present invention.
Figure 4B:
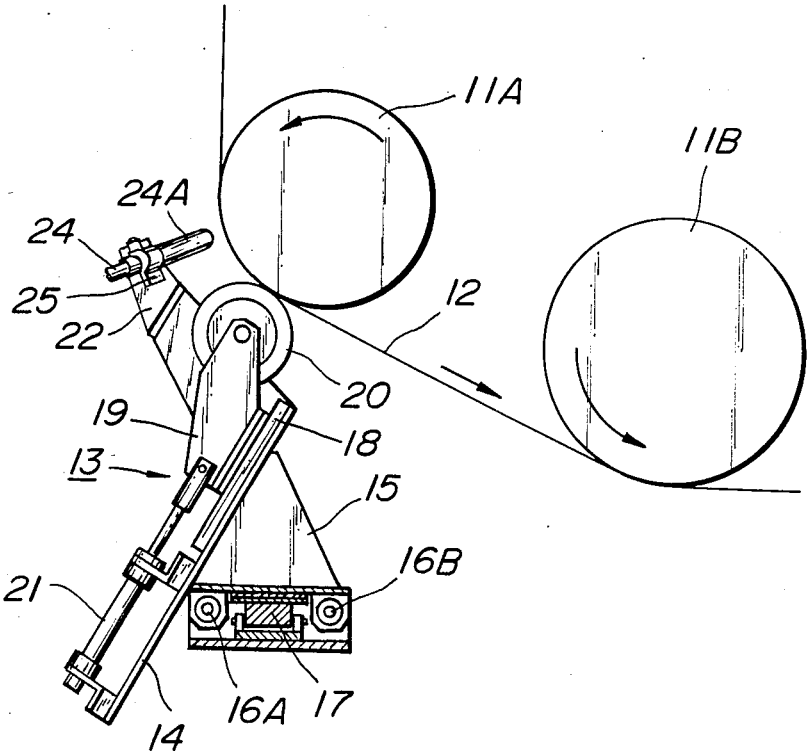
FIG. 4B is a partially sectional side view illustrating the head portion shown in FIG. 4A.

Referring now to FIGS. 4A and 4B, there is shown a head section of an apparatus for cutting an edge portion of a coating sheet according to the present invention.

In this embodiment, a selvage rubber portion of a coating sheet 12 conveyed by conveyor rollers 11A and 11B in the direction shown by an arrow is cut out to a given width at the portion of conveyor roller 11A. A base plate 14 of the head section 13 is slidably held by two fixed guide rails 16A and 16B which are extended in the axial direction of the conveyor roller 11A, through a bracket 15, in such a manner that the base plate 14 can be moved along the guide rails 16A and 16B by operation of a linear pulse motor 17. The base plate 14 is provided with a slider 19 capable of moving in the radial direction of the conveyor roller 11A by a slider holding member 18. A cutter 20 for cutting the an edge portion of the coating sheet 12 is pivotably provided to the slider 19 which is selectively moved in the radial direction of the conveyor roller 11A by an air cylinder 21 fixed to the base plate 14, so that the cutter 20 can cut out the an edge portion of the coating sheet selectively. The base plate 14 is also provided with a holder frame 22, to which an exit end portion 23A of a light guide 23 for projecting light onto a region including at least the most externally positioned cord portion of the coating sheet 12 and an entrance end portion 24A of an image guide 24 receiving its reflected light are integrally secured by a holder member 25. In this embodiment, the exit end portion 23A of the light guide 23 is secured to the holder frame 22 so that an angle between a light ray projected through the light guide 23 and a plane perpendicularly intersecting to an axis of the conveyor roller 11A, that is, an incident angle at flat portions of the coating sheet 12 becomes 30° to 60°, thereby projecting light onto a region of a plurality of cord portions including the most externally positioned cord portion and the selvage rubber portion. The entrance end portion 24A of the image guide 24 is secured to the holder frame 22 so that the inlet end portion receives a regular reflection light from the above region.

Figure 5:
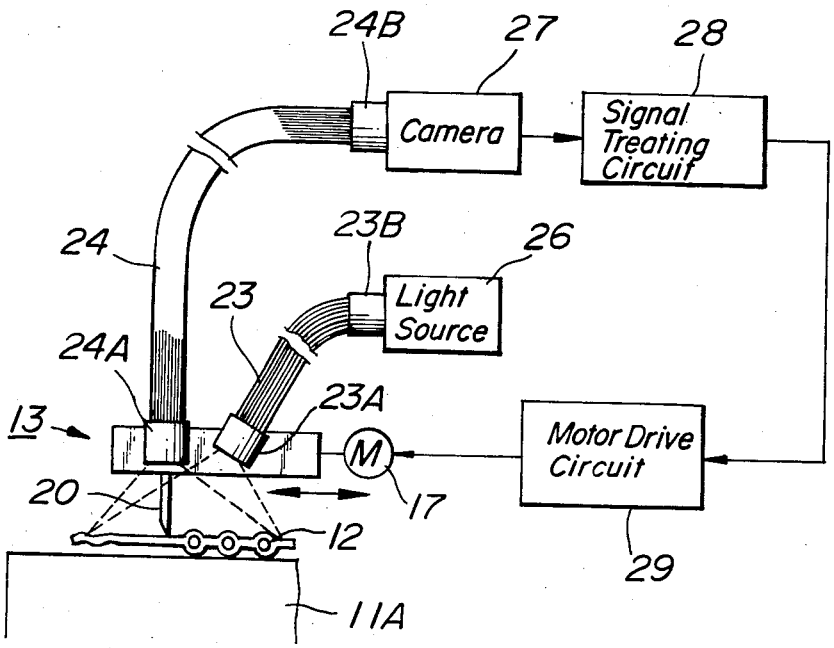
FIG. 5 is a schematic view showing whole construction of the apparatus for cutting an edge portion of the coating sheet according to the present invention.

FIG. 5 shows one embodiment of whole construction of an apparatus for cutting out an edge portion of a coating sheet according to the present invention. An entrance end portion 23B of the light guide 23 having the exit end portion 23A secured to the head section 13 shown in FIG. 4 is optically connected to a light source 26 such as halogen lamp, etc. An exit end portion 24B of the image guide 24 having the entrance end portion 24A secured to the head section 13 is optically connected to a camera 27 incorporating an image sensor therein. The camera 27 converts the amount of intensity distribution of reflected light in the transversal direction of the coating sheet 12 into electrical signals which are supplied to a signal treating circuit 28. In the signal treating circuit 28, the position of the most externally positioned cord portion is detected on the basis of output signals of the camera 27 thereby obtaining a shifted amount between the detected position and a present position. The signal treating circuit 28 also generates a deviation signal corresponding to the shifted amount which is supplied to a motor drive circuit 29 so that the linear pulse motor 17 is driven. The drive of the linear pulse motor 17 controls the head section 13 in such a manner that the most externally positioned cord portion may be detected at a preset position, that is, the cutter 20 is always placed at a given position to the most externally positioned cord portion, thereby cutting the selvage rubber portion to the given width.

Figure 6A:
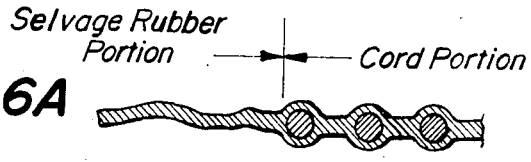
FIG. 6A is a cross-sectional view illustrating the an edge portion of the coating sheet for explaining the operation of the apparatus shown in FIG. 5.
Figure 6B:
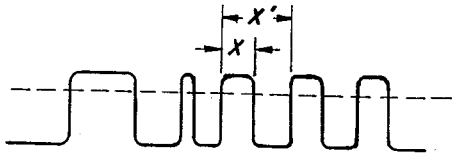
FIG. 6B is a diagrammatic view showing an intensity distribution of the reflection light detected by the image sensor for use in the apparatus shown in FIG. 5.

When the end portion of the coating sheet 12 has an uneven cross-section, that is, as shown in FIG. 6A, the selvage rubber portion has an uneven surface, the output signals of the camera 27 based on the light intensity distribution of said end portion become high level as shown in FIG. 6B at the position corresponding to the selvage rubber portion in the same manner as the cord portions. When the output signals of the camera 27 are compared with a reference value in the signal treating circuit 28 and the signal larger than the reference value is present at the selvage rubber portion, therefore, this signal is detected as a cord portion so that the rised surface portion of the selvage rubber portion may be detected as the most externally positioned cord portion in error.

In the present embodiment, the signal treating circuit 28 shapes the output signals of the camera 27 by comparing them with a reference level shown in FIG. 6B by a dotted line to generate a plurality of pulses and treats these pulses thereby obtaining width X of respective pulses and pulse interval X' of successive pulses. Then, a plurality of pulse widths X and pulse intervals X' are treated to obtain mean values $\overline{X}$ and $\overline{X}'$, except the maximum value and the minimum value thereof and then the differences between these mean values $\overline{X}$ and $\overline{X}'$ and successive pulse widths X and pulse intervals X' are obtained, respectively, in the direction from the selvage rubber portion to the cord portion, in order. When these differences satisfy a predetermined condition, providing that the width of a certain pulse is defined as $X_n$ and the interval between this pulse and the next pulse is defined as $X'_n$, if the relations $|X_n-\overline{X}|$ and $|X'_n-\overline{X}'|$ have following conditions, $|X_n-\overline{X}|\leqq\alpha$, and $|X'_n-\overline{X}'|\leqq\beta$, wherein $\alpha$ and $\beta$ are predetermined tolerances, this pulse is detected as a pulse representing the most externally positioned cord portion, thereby generating a deviation signal of this pulse position to the preset position. In this way, even if a signal having the same level as that of the cord portion is generated at the selvage rubber portion, the position of the most externally positioned cord portion can always be detected surely.

As described above, the apparatus according to the present invention can optically detect the position of the most externally positioned cord portion so that it can be effectively applied to the cord consisting of whether steel or textile. The present invention utilizes the light guide and the image guide to minimize the detecting head section so that the head section and the cutter are closely arranged in the sheet conveying direction in a uniform body and thus the selvage rubber portion can always be cut out to the given width with high precision. Moreover, positions of a plurality of cord portions are detected and then the position of the most externally positioned cord portion is detected on the basis of the thus detected position of the cord portion so that even if the selvage rubber portion has an uneven surface in the same manner as the cord portion the most externally positioned cord portion can always be positively detected.

It is further understood by those skilled in the art that the foregoing description is a preferred embodiment of the disclosed device and that various changes and modifications may be made in the invention without departing from the spirit and scope thereof. For example, the head section may be moved by a moving mechanism such as ball screw or the like instead of the linear pulse motor. The light may also be projected onto the required region through a magnifying lens which is arranged opposite to an exit end surface of the light guide. The light reflected from the required region may be received through a wide-angle lens which is arranged opposite to an entrance end surface of the image guide. In this way the diameter of the light guide and the image guide may be decreased.

What is claimed is:

1. In an apparatus for cutting out an edge portion of a coating sheet wherein a plurality of cords arranged at substantially equal intervals and in parallel with each other and conveyed along a predetermined path are integrally coated with rubber or the like to form cord portions in such a manner that the cord portions are expanded, to a predetermined length from a most externally positioned cord portion of the coating sheet in transversal direction thereof, comprising; a cutter for cutting out an edge portion of the conveying coating sheet, projecting means having a light source and a light guide which projects light emanated from the light source onto a region including at least the most externally positioned cord portion of the coating sheet, said projection means further comprising; a photoelectric conversion means for converting the amount of intensity distribution of light emanated from an image guide into electrical output signals, and signal treating means for detecting positions of a plurality of the cord portions and for detecting the position of the most externally positioned cord portion based on the detected positions of the cord portions; wherein the signal treating means shapes the output signals of the photoelectric conversion means by comparing them with a reference level to generate a plurality of pulses, treats these pulses to obtain widths $X_n$ of respective pulses and pulse intervals $X'_n$ of successive pulses, and treats a plurality of pulse widths $X_n$ and pulse intervals $X'_n$ to obtain mean value $\overline{X}_n$ and $\overline{X}'_n$, except the maximum value and the minimum value thereof and obtain differences between these mean values $\overline{X}_n$ and $\overline{X}'_n$ and successive pulse widths $X_n$ and pulse intervals $X'_n$, respectively, in the direction from the edge portion to the cord portion, in order, whereby when these differences satisfy a predetermined condition, if the relations $|X_{n+1}-\overline{X}_n|$ and $|X_{n+1}-\overline{X}'_n|$ have the following conditions, $|X_{n+1}-\overline{X}_n| \leqq \alpha$, and $|X'_{n+1}-\overline{X}'_n| \leqq \beta$, wherein $\alpha$ and $\beta$ are predetermined tolerances, the most externally positioned cord portion is detected; detection means having the image guide which receives light projected by the projection means and reflected from the coating sheet and for detecting the position of the most externally positioned cord portion based on the intensity distribution of the light emanated from the image guide, a head for integrally holding the cutter, an exit edge portion of the light guide and an entrance edge portion of the image guide, head translating means for moving the head in the transversal direction of the coating sheet, and means for controlling means in such a manner that the cutter is always positioned at the predetermined position to the most externally positioned cord portion of the coating sheet.

2. The apparatus of claim 1, wherein said photoelectric conversion means comprises a camera having an image sensor.

3. The apparatus of claim 2, wherein said head includes a holder frame and said image guide has said entrance edge portion secured to said holder frame and said guide light has said exit edge portion secured to said holder frame.

4. The apparatus of claim 3, wherein said exit edge portion of said light guide is oriented by said holder from that light projected through said light guide strikes said coating sheet at an incident angle in the range of 30°-60°.

5. The apparatus of claim 1, further comprising means to move said cutter into cutting engagement with said coating sheet.

6. The apparatus of claim 1, wherein said head translating means comprises guide rail means extending in a direction perpendicular to said predetermined path of travel of said sheet, said head mounted on said guide rail means, and motor means for moving said head along said guide rail means.

7. The apparatus of claim 6, wherein said motor means comprises a linear pulse motor and a motor drive circuit receiving an output from said signal treating means to drive said linear pulse motor.

* * * * *